US009044128B1

(12) United States Patent
Thomas

(10) Patent No.: US 9,044,128 B1
(45) Date of Patent: Jun. 2, 2015

(54) EDGE CLEANING VACUUM SWEEPER SYSTEM

(71) Applicant: George Thomas, Odessa, FL (US)

(72) Inventor: George Thomas, Odessa, FL (US)

( * ) Notice: Subject to any disclaimer, the term of this patent is extended or adjusted under 35 U.S.C. 154(b) by 0 days.

(21) Appl. No.: 14/478,745

(22) Filed: Sep. 5, 2014

Related U.S. Application Data

(60) Provisional application No. 61/875,659, filed on Sep. 9, 2013.

(51) Int. Cl.

| | |
|---|---|
| ***A47L 9/02*** | (2006.01) |
| ***A47L 5/28*** | (2006.01) |
| ***A47L 9/04*** | (2006.01) |
| ***A47L 9/06*** | (2006.01) |

(52) U.S. Cl.
CPC ..... *A47L 5/28* (2013.01); *A47L 9/0488* (2013.01); *A47L 9/06* (2013.01)

(58) Field of Classification Search
CPC ..... A47L 5/28; A47L 9/0488; A47L 9/06
USPC ..... 15/415.1, 418
IPC ..... A47L 9/02
See application file for complete search history.

(56) References Cited

U.S. PATENT DOCUMENTS

| | | | | |
|---|---|---|---|---|
| 3,942,219 | A * | 3/1976 | Johnson | 15/383 |
| 4,499,628 | A * | 2/1985 | Platt | 15/419 |
| 7,171,723 | B2 * | 2/2007 | Kobayashi et al. | 15/325 |

* cited by examiner

*Primary Examiner* — David Redding

(57) ABSTRACT

A lower section has an open bottom, a closed top, and intermediate front and side panels defining a vacuum chamber there within. Each panel has a lower generally vertical leg with a horizontally disposed pivot pin couples each panel to the top. A bumper extending outwardly from each vertical leg moves into operative proximity with an edge of a floor and pivots a panel to increase the size of the vacuum chamber for overlying and vacuuming dust adjacent to the edge of the floor.

9 Claims, 5 Drawing Sheets

FIG. 7
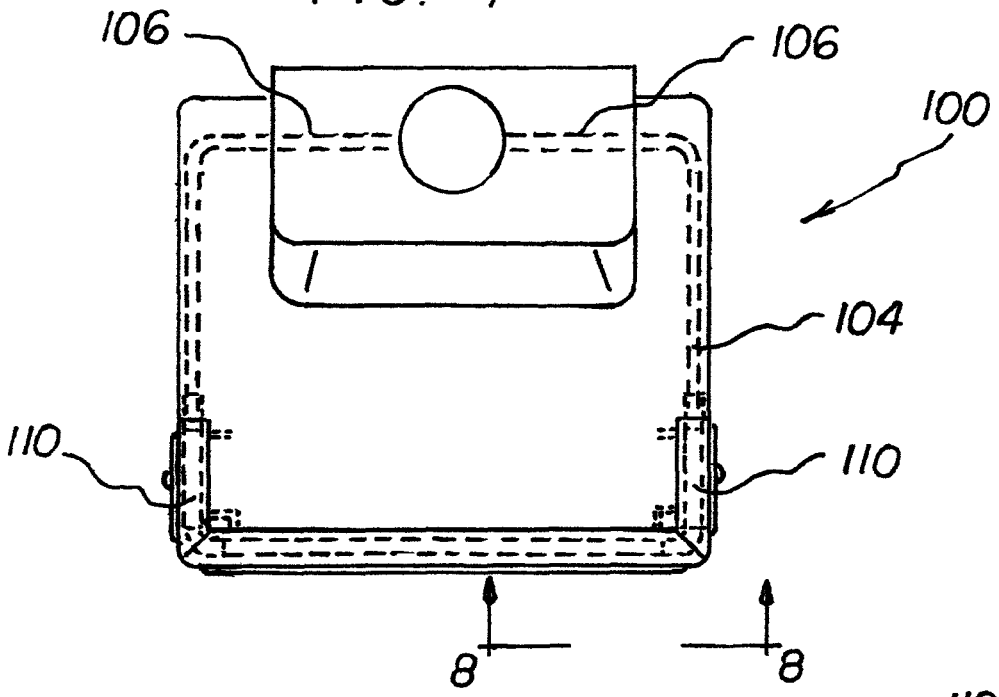
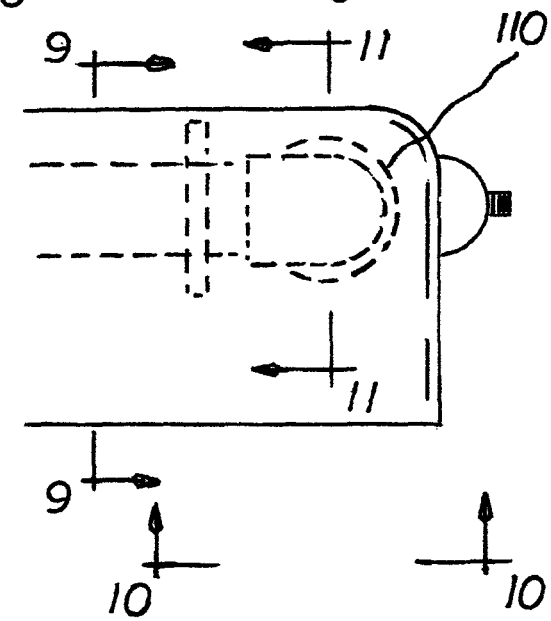
FIG. 8
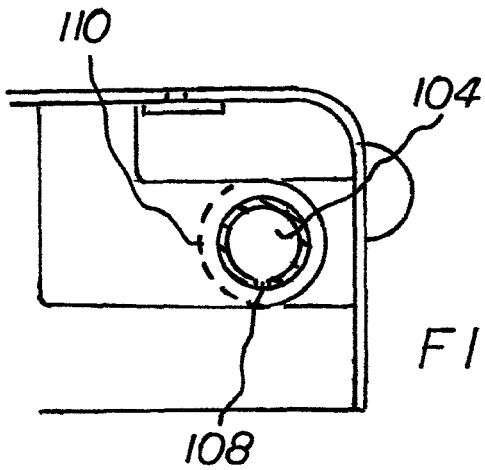
FIG. 9

FIG. 10
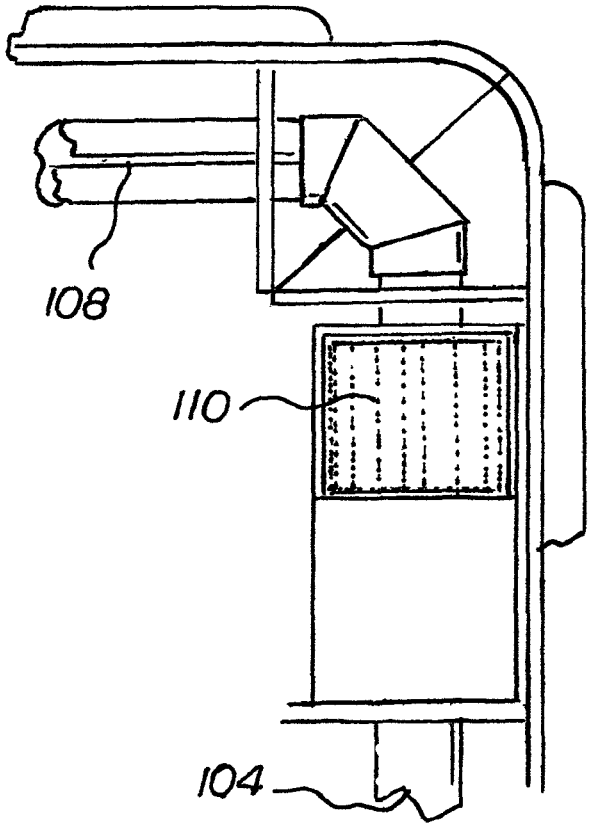
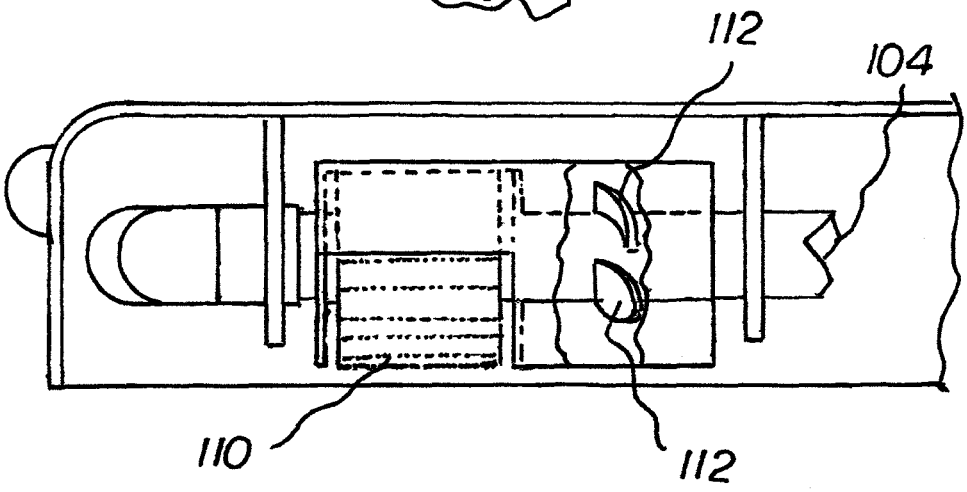
FIG. 11

EDGE CLEANING VACUUM SWEEPER SYSTEM

RELATED APPLICATION

This non-provisional application is based upon Provisional Application No. 61/875,659 filed Sep. 9, 2013, the subject matter of which is incorporated herein by reference.

BACKGROUND OF THE INVENTION

1. Field of the Invention

The present invention relates to an edge cleaning vacuum sweeper system and more particularly pertains to vacuuming floors including edges of floors through the reconfiguring of the system, the reconfiguring being caused by contact with the edges, the vacuuming and contacting and reconfiguring being done in a safe, convenient and economical manner.

2. Description of the Prior Art

The use of vacuum sweeper systems of known designs and configurations is known in the prior art. More specifically, vacuum sweeper systems of known designs and configurations previously devised and utilized for the purpose of vacuuming floors and edges of floors are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, the aforementioned patents do not describe an edge cleaning vacuum sweeper system that allows the vacuuming floors including edges of floors through the reconfiguring of the system, the reconfiguring being caused by contact with the edges, the vacuuming and contacting and reconfiguring being done in a safe, convenient and economical manner.

In this respect, the edge cleaning vacuum sweeper system according to the present invention substantially departs from the conventional concepts and designs of the prior art, and in doing so provides an apparatus primarily developed for the purpose of vacuuming floors including edges of floors through the reconfiguring of the system.

Therefore, it can be appreciated that there exists a continuing need for a new and improved edge cleaning vacuum sweeper system which can be used for vacuuming floors including edges of floors through the reconfiguring of the system, the reconfiguring being caused by contact with the edges, the vacuuming and contacting and reconfiguring being done in a safe, convenient and economical manner. In this regard, the present invention substantially fulfills this need.

SUMMARY OF THE INVENTION

In view of the disadvantages inherent in the known types of vacuum sweeper systems of known designs and configurations now present in the prior art, the present invention provides an improved edge cleaning vacuum sweeper system. As such, the general purpose of the present invention, which will be described subsequently in greater detail, is to provide a new and improved edge cleaning vacuum sweeper system and method which has all the advantages of the prior art and none of the disadvantages.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including such equivalent constructions insofar as they do not depart from the spirit and scope of the present invention.

For a better understanding of the invention, its operating advantages and the specific objects attained by its uses, reference should be had to the accompanying drawings and descriptive matter in which there is illustrated preferred embodiments of the invention.

From a broad context, to attain this, the present invention essentially comprises a lower section, an upper section, and a handle. The lower section has an open bottom and a closed top and intermediate front and side panels. The top and the bottom and front and side panels define a vacuum chamber there within. Each panel has a lower generally vertical leg with a horizontally disposed pivot pin coupling each panel to the top. A bumper extends outwardly from each vertical leg and is adapted to move into operative proximity with an edge of a floor and thereby pivot a panel to increase the size of the vacuum chamber for overlying and vacuuming dust adjacent to the edge of the floor. Such components are individually configured and correlated with respect to each other so as to attain the desired objective.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved edge cleaning vacuum sweeper system which has all of the advantages of the prior art vacuum sweeper systems of known designs and configurations and none of the disadvantages.

It is another object of the present invention to provide a new and improved edge cleaning vacuum sweeper system which may be easily and efficiently manufactured and marketed.

It is further object of the present invention to provide a new and improved edge cleaning vacuum sweeper system which is of durable and reliable constructions.

An even further object of the present invention is to provide a new and improved edge cleaning vacuum sweeper system which is susceptible of a low cost of manufacture with regard to both materials and labor, and which accordingly is then susceptible of low prices of sale to the consuming public, thereby making such edge cleaning vacuum sweeper system economically available to the buying public.

Lastly, another object of the present invention is to provide an edge cleaning vacuum sweeper system for vacuuming floors including edges of floors through the reconfiguring of the system, the reconfiguring being caused by contact with the edges, the vacuuming and contacting and reconfiguring being done in a safe convenient and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is a plan view of an alternate embodiment of the invention.

FIG. 8 is a front elevational view taken along line 8-8 of FIG. 7.

FIGS. 9 and 11 art cross sectional views taken along lines 9-9 and 11-11 of FIG. 8.

FIG. 10 is a bottom view taken along line 10-10 of FIG. 8.

The same reference numerals refer to the same parts throughout the various Figures.

DESCRIPTION OF THE PREFERRED EMBODIMENT

Figure 1:
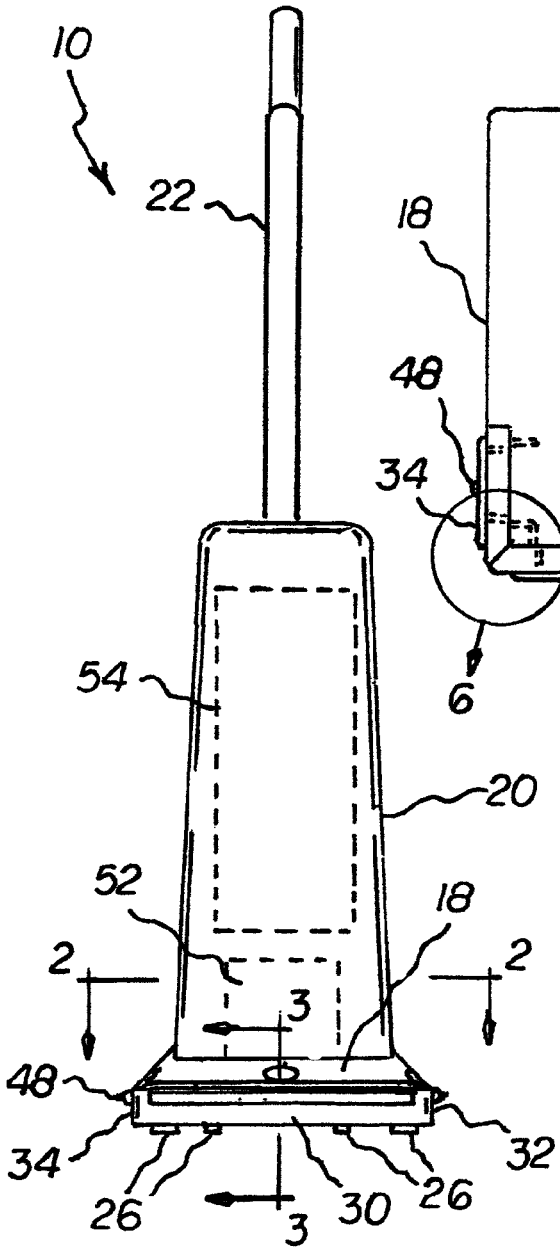
FIG. 1 is a front elevational view of an edge cleaning vacuum sweeper system constructed in accordance with the principles of the present invention.
Figure 2:
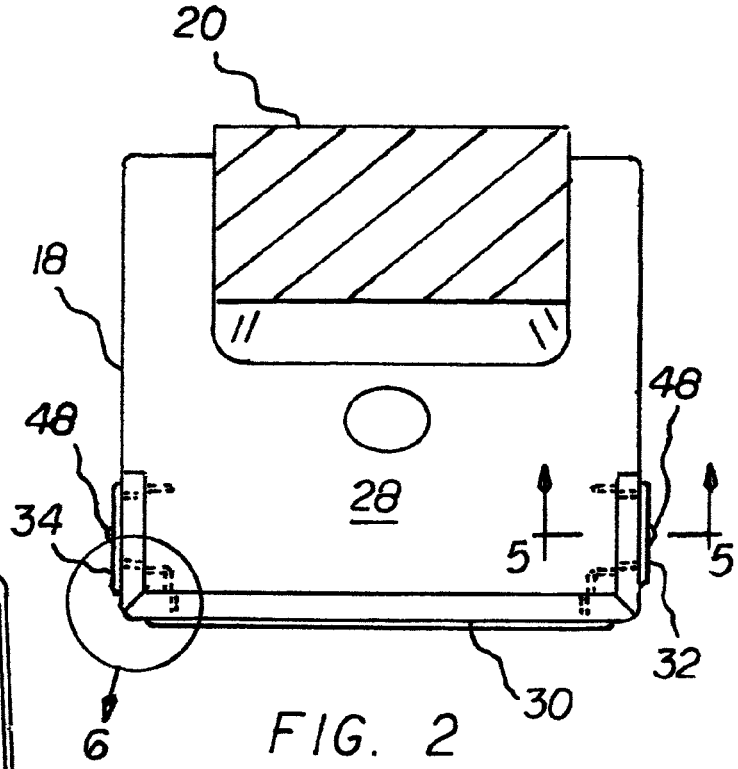
FIGS. 2 and 3 are cross sectional views taken along lines 2-2 and 3-3 of FIG. 1.

With reference now to the drawings, and in particular to FIG. 1 thereof, the preferred embodiment of the new and improved edge cleaning vacuum sweeper system embodying the principles and concepts of the present invention and generally designated by the reference numeral 10 will be described.

The present invention, the edge cleaning vacuum sweeper system 10 is comprised of a plurality of components. Such components in their broadest context include a lower section, an upper section, and a handle. Such components are individually configured and correlated with respect to each other so as to attain the desired objective.

From a specific standpoint, the preferred embodiment of the edge cleaning vacuum sweeper system, designated by reference numeral 10, is for vacuuming floors 12 including edges 14 of floors through the reconfiguring of the system. The reconfiguring is caused by contact with the edges. The vacuuming and contacting and reconfiguring are done in a safe, convenient and economical manner. Provided in the preferred embodiment are a lower section 18, an upper section 20, and a handle 22.

Figure 3:
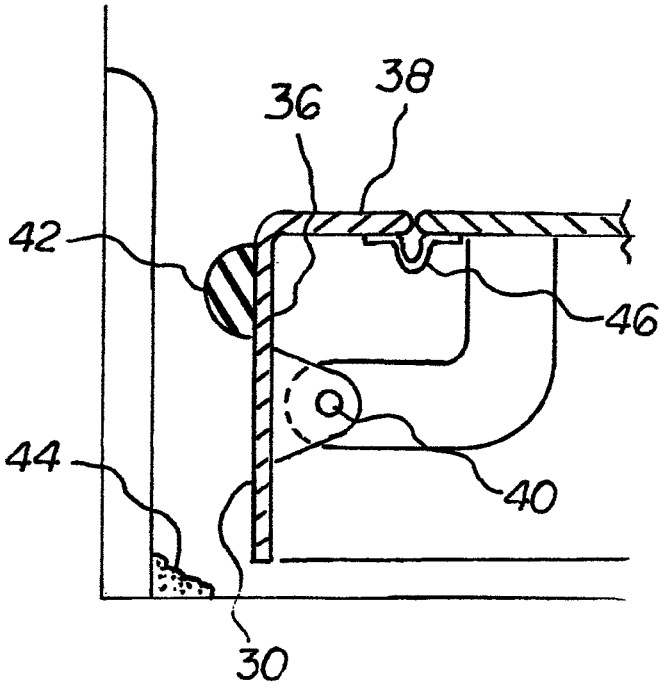
Figure 4:
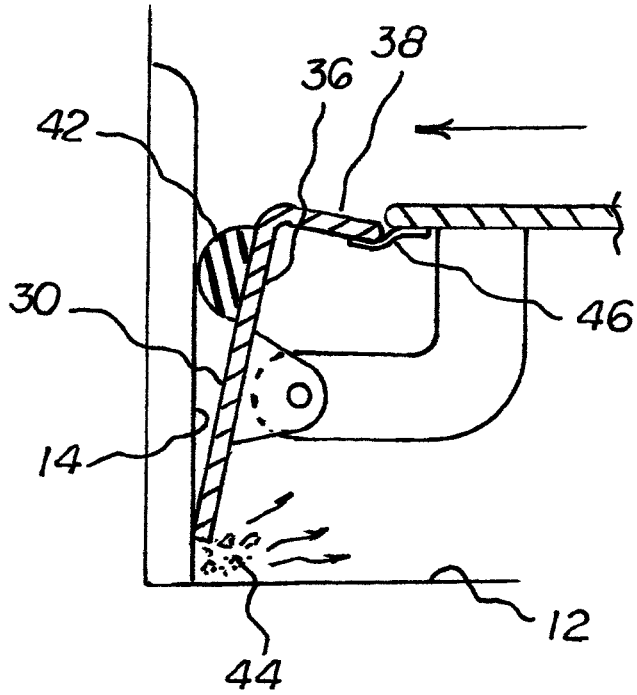
FIG. 4 is a cross sectional view similar to FIG. 3 but with the side panel open.
Figure 5:
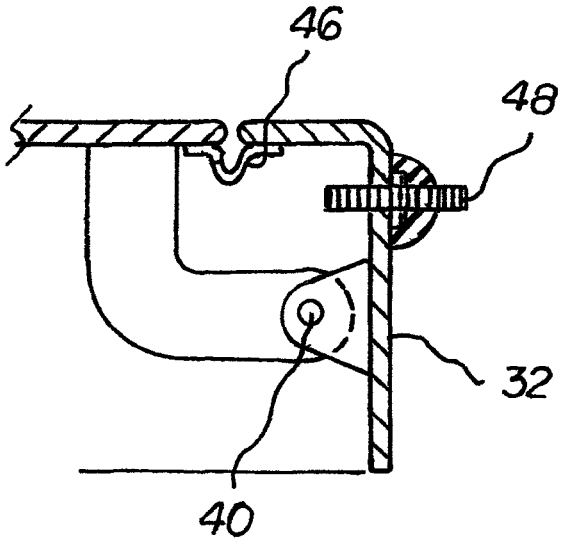
FIG. 5 is a cross sectional views taken along lines 5-5 of FIG. 2.
Figure 6:
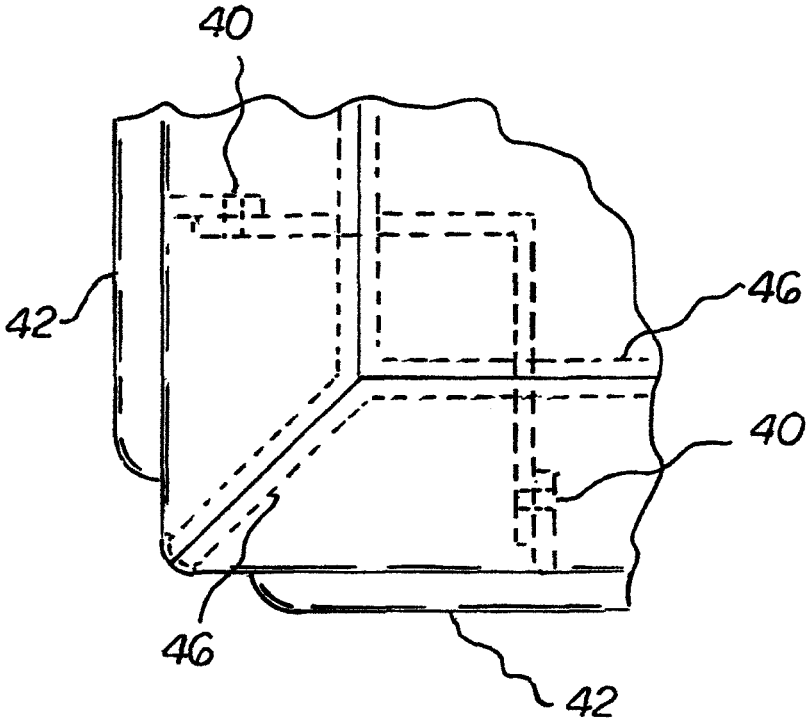
FIG. 6 is an enlarged plan view taken at circle 6 of FIG. 2.

The lower section 18 is positionable on the floor to be vacuumed. The lower section has an open bottom with wheels 26 to facilitate movement across the floor. The lower section has a closed top 28. The lower section also has a front panel 30, a left side panel 32, and a right side panel 34. The top and the bottom and the front panel and the side panels define a vacuum chamber there within. Each panel is formed in an inverted L-shaped configuration with a lower generally vertical leg 36 and an upper generally horizontal leg 38. A horizontally disposed pivot pin 40 couples each panel to the top. A semi-cylindrical bumper 42 extends outwardly from each vertical leg adjacent to the horizontal leg. The bumper is fabricated of an elastomeric material. The bumper of each panel is adapted to contact the edges of the floor during vacuuming to thereby pivot the contacted panel and increase the size of the vacuum chamber for overlying and vacuuming dust 44 adjacent to the edges of the floor. Compare FIGS. 3 and 4. A flexible strap 46 couples each horizontal leg to the top for abating the unintended loss of vacuum from the vacuum chamber. A guide wheel 48 extends centrally through the bumpers of the left and right side panels. The guide wheel of each side panel is rotatable about a vertical axis. Each guide wheel is adapted to contact an edge of the floor to thereby pivot the contacted side panel and increase the size of the vacuum chamber for overlying and vacuuming dust adjacent to the edges of the floor.

The upper section 20 is operatively coupled to the top and extends upwardly therefrom. The upper section includes a motor 52 for creating a vacuum in the vacuum chamber. The upper section includes a collector 54 for the vacuumed dust.

The handle 22 is coupled to the upper section and extends upwardly therefrom. The handle is adapted to be held by a user during operation and use for moving the lower section over a floor to be vacuumed.

An alternate embodiment of the invention is illustrated in FIGS. 7 through 11. In this embodiment of the system 100 a vacuum tube 104 is provided. The vacuum tube has terminal ends 106 in the upper section. The vacuum tube extends throughout the vacuum chamber. The vacuum tube has downwardly facing slots 108 adjacent to the front panel and side panels. In this embodiment, the system further includes a brush 110 adjacent to each side panel within the vacuum chamber. Each brush is mounted on and rotatable about the vacuum tube. The system further includes a set of impellers 112 adjacent to each side panel within the vacuum chamber. Each set of impellers is mounted on and rotatable about the vacuum tube. Each set of impellers is operatively coupled to an associated brush whereby vacuum within the vacuum chamber will rotate the sets of impellers and the brushes to contact dust and promote vacuuming.

In another alternate embodiment of the invention, the pivoting of the panel is achieved by contact between each vertical leg and the edge of the floor. It should be understood, however, that the pivoting could be controlled electronically as by a proximity sensor.

In still another alternate embodiment, the pivoting of the side panel is achieved by contact between each guide wheel and the edge of the floor. It should be understood, however, that the pivoting could be controlled electronically as by a proximity sensor.

The present invention was developed after noticing that known vacuum cleaners do not properly clean the area of the carpet adjacent to the wall, and dirt, debris and sometimes bugs accumulate at this location. The most effective way to reach the area is by using a sweeper attachment, which most people do not use because of the hassle of stopping the vacuum process and attaching and taking apart the attachments every time you are near a wall. The proposed improvement creates a smooth, and intuitive way to reach areas traditional vacuum cleaners do not reach. All that is needed is to push the vacuum cleaner to the wall and a pivot will open up a suction element to provide additional suction area.

According to consumer reports the ability of a vacuum cleaner to clean the area between the wall and carpet is an important feature in purchasing a vacuum cleaner. Therefore, enhancing the edge cleaning feature of a vacuum cleaner will greatly increase its usability and sales.

When the vacuum with the push pivot edges of the present invention touches the wall, the edges on the vacuum cleaner pivot open and an additional suction element and the opening can be used to provide suction to the area at the wall and carpet edges. Current vacuum cleaners do not provide any form of vacuuming at this location. The additional suction element is a vacuum tube under the push pivot edge that activates, when the "push pivot edge" is pushed towards or touches the wall. The edge cleaning mechanisms will provide suction to the carpet edges. The mechanism works in a natural motion, there is no need to stop vacuuming and reconfigure the cleaner. All is needed is to push the vacuum cleaner towards the wall and the push pivot mechanism will open up a suction element with a rolling brush to sweep and vacuum the carpet edges adjacent to the wall. The push pivot mechanism on both sides of the vacuum has rollers so that the edges could be vacuumed in motion. As the rollers touches the wall in a safe manner, the bottom pivots up and a suction element vacuums the edges. The front of the vacuum will have a wider bumper type push mechanism that will open up when it is pushed against the wall. All three sides of the vacuum cleaner pivots up to provide better access to wall/carpet edges for superior vacuum performance in regards to edge cleaning.

Depending on the suction power of the vacuum, additional features such as a vacuum activated brush agitator could be installed to give an additional cleaning mechanism for the vacuum cleaner. The vacuum activated brush agitator could be installed along the side edges of the vacuum cleaner, while for the front the main vacuum agitator could be pushed slightly forward when "push pivot edge" is pushed towards or touches the wall. See figures below.

Edge cleaning effectiveness of a vacuum cleaner is an important factor in determining the effectiveness of a vacuum. The American Society for Testing and Materials has created a testing method, ASTM F2797 to evaluate a vacuum cleaner's edge cleaning effectiveness. In addition Consumer Report reports also uses edge cleaning effectiveness of as a major factor in rating vacuum cleaner for their reports. Therefore, edge cleaning effectiveness is an important feature in determining the effectiveness of a vacuum cleaner. Just as James Dyson disrupted the traditional vacuum cleaner suction with the cyclone separation, edge cleaning features will be an important feature in future vacuum cleaners.

The proposed edge cleaning feature for the vacuum cleaner of the present invention will provide an economic, efficient and intuitive solution to cleaning the area between the wall and carpet edges. The vacuum cleaner market is large, the annual sale of vacuum cleaners in the US alone is over 26 million, and therefore this improvement could enhance the competitiveness of manufacturer that uses this technology.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An edge cleaning vacuum sweeper system comprising:
a lower section and an upper section and a handle;
the lower section having an open bottom and a closed top and intermediate front and side panels, the top and the bottom and front and side panels defining a vacuum chamber there within, each panel having a lower generally vertical leg with a horizontally disposed pivot pin coupling each panel to the top, a bumper extending outwardly from each vertical leg adapted to move into operative proximity with an edge of a floor and thereby pivot a panel to increase the size of the vacuum chamber for overlying and vacuuming dust adjacent to the edge of the floor.

2. The system as set forth in claim 1 wherein the pivoting of the panel is achieved by contact between each vertical leg and the edge of the floor.

3. The system as set forth in claim 1 wherein each panel is formed in an inverted L-shaped configuration with the generally vertical leg below and a generally horizontal leg above and further including a flexible strap coupling the generally horizontal leg to the top for abating unintended vacuum loss.

4. The system as set forth in claim 1 and further including:
a guide wheel extending through the bumpers of the side panels, the guide wheel of each side panel being rotatable about a vertical axis, each guide wheel adapted to move into operative proximity with the edge of the floor to thereby pivot the side panel and increase the size of the vacuum chamber for overlying and vacuuming dust adjacent to the edge of the floor.

5. The system as set forth in claim 4 wherein the pivoting of the side panel is achieved by contact between each guide wheel and the edge of the floor.

6. The system as set forth in claim 1 wherein the upper section is operatively coupled to the top and extending upwardly therefrom, the upper section including a motor for creating a vacuum in the vacuum chamber, the upper section including a collector for vacuumed dust.

7. The system as set forth in claim 5 wherein the handle is coupled to the upper section and extends upwardly therefrom, the handle adapted to be held by a user during operation and use for moving the lower section over the floor to be vacuumed.

8. The system (100) as set forth in claim 1 and further including a vacuum tube (104) having terminal ends (106) in the upper section, the vacuum tube extending throughout the vacuum chamber, the vacuum tube having downwardly facing slots (108) adjacent to the front panel and side panels, the system further including a brush (110) adjacent to each side panel within the vacuum chamber, each brush being mounted on and rotatable about the vacuum tube, the system further including a set of impellers (112) adjacent to each side panel within the vacuum chamber, each set of impellers being mounted on and rotatable about the vacuum tube, each set of impellers being operatively coupled to an associated brush whereby vacuum within the vacuum chamber will rotate the sets impellers and the brushes to contact dust and promote vacuuming.

9. An edge cleaning vacuum sweeper system 10 for vacuuming floors (12) including edges (14) of floors through the reconfiguring of the system, the reconfiguring being caused by contact with the edges, the vacuuming and contacting and reconfiguring being done in a safe, convenient and economical manner, the edge cleaning vacuum sweeper system comprising, in combination:

a lower section (18) and an upper section (20) and a handle (22);

the lower section being positionable on the floor to be vacuumed, the lower section (18) having an open bottom with wheels (26) to facilitate movement across the floor, the lower section having a closed top (28), the lower section having a front panel (30) and a left side panel (32) and a right side panel (34), the top and the bottom and the front panel and the side panels defining a vacuum chamber there within, each panel being formed in an inverted L-shaped configuration with a lower generally vertical leg (36) and an upper generally horizontal leg (38), a horizontally disposed pivot pin (40) coupling each panel to the top, a semi-cylindrical bumper (42) extending outwardly from each vertical leg adjacent to the horizontal leg, the bumper being fabricated of an elastomeric material, the bumper of each panel adapted to contact the edges of the floor during vacuuming to thereby pivot the contacted panel and increase the size of the vacuum chamber for overlying and vacuuming dust (44) adjacent to the edges of the floor, a flexible strap (46) coupling each horizontal leg to the top for abating the unintended loss of vacuum from the vacuum chamber, a guide wheel (48) extending centrally through the bumpers of the left and right side panels, the guide wheel of each side panel being rotatable about a vertical axis, each guide wheel adapted to contact an edge of the floor to thereby pivot the contacted side panel and increase the size of the vacuum chamber for overlying and vacuuming dust adjacent to the edges of the floor;

the upper section (20) operatively coupled to the top and extending upwardly therefrom, the upper section including a motor (52) for creating a vacuum in the vacuum chamber, the upper section including a collector (54) for the vacuumed dust; and the handle (22) coupled to the upper section and extending upwardly therefrom, the handle adapted to be held by a user during operation and use for moving the lower section over a floor to be vacuumed.

* * * * *